US005482095A

United States Patent [19]

de Chollet

[11] Patent Number: 5,482,095

[45] Date of Patent: Jan. 9, 1996

[54] CASE FOR A DOSING ACCESSORY ADAPTED TO BE FIXED ON A BOTTLE

[75] Inventor: Michel de Chollet, Paris, France

[73] Assignee: Laboratoire Suppo Steril, Rambouillet, France

[21] Appl. No.: 295,206

[22] Filed: Aug. 24, 1994

[30] Foreign Application Priority Data

Aug. 26, 1993 [FR] France ..... 93 10267

[51] Int. Cl.[6] ..... B65D 21/00

[52] U.S. Cl. ..... 141/380; 141/18; 141/98; 220/23.4; 220/23.83; 220/735; 220/737; 222/192; 206/229; 73/426

[58] Field of Search ..... 141/18, 21, 98, 141/325, 319, 343, 379, 380, 391; 73/426–428; 222/192; 220/23.4, 23.83, 23.86, 735, 737; 206/229, 364, 553, 571

[56] References Cited

U.S. PATENT DOCUMENTS

| | | | |
|---|---|---|---|
| 599,674 | 2/1898 | Woodward | 73/427 |
| 617,952 | 1/1899 | Burton | 73/427 X |
| 1,768,771 | 7/1930 | Tourrette | 141/380 |
| 2,335,015 | 11/1943 | Lantheaume | 206/229 |
| 2,536,215 | 1/1951 | Povondra | 220/735 X |
| 2,613,517 | 10/1952 | Frantz | 220/23.83 X |
| 3,353,717 | 11/1967 | Edwards | 220/23.4 X |
| 3,732,591 | 5/1973 | Gach | 222/192 X |
| 4,620,631 | 11/1986 | Bartelt | 220/737 X |
| 4,856,647 | 8/1989 | Dahne | 220/23.83 X |
| 5,178,354 | 1/1993 | Engvall | 220/735 X |
| 5,305,928 | 4/1994 | Verdaguer | 222/192 |

*Primary Examiner*—J. Casimer Jacyna
*Attorney, Agent, or Firm*—Shenier & O'Connor

[57] ABSTRACT

This invention relates to a case for dosing accessories adapted to be adhered to a bottle. Said case comprises a front wall, a rear wall, two side walls, an open upper end and a lower end, and presents a housing adapted to receive, at least partially, a dosing accessory received via said open upper end. The housing is delimited by the front rear and side walls, which are integral with one another. The rear wall is capable of being adhered to the bottle, and is elastically deformable to fit on bottles of different curvatures.

11 Claims, 1 Drawing Sheet

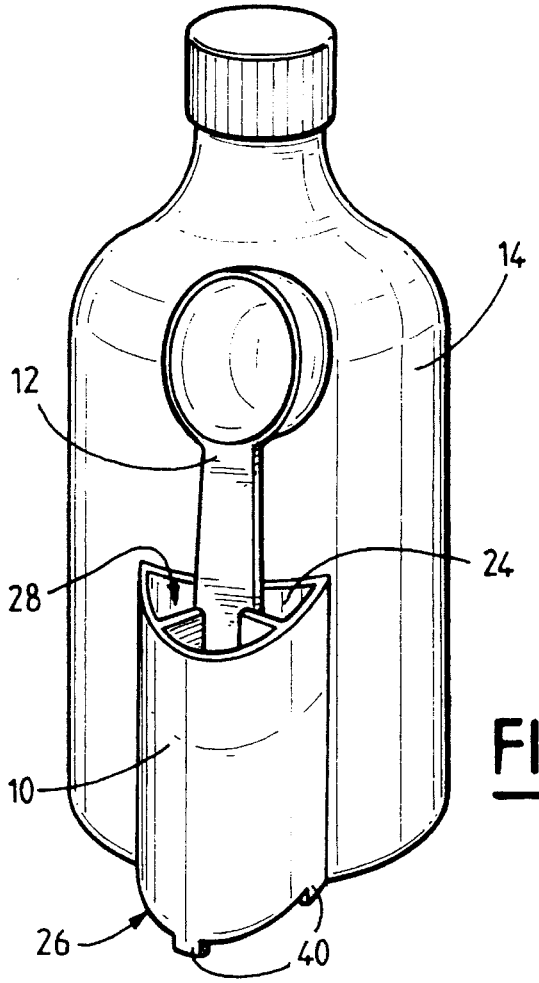
FIG. 1
FIG. 2
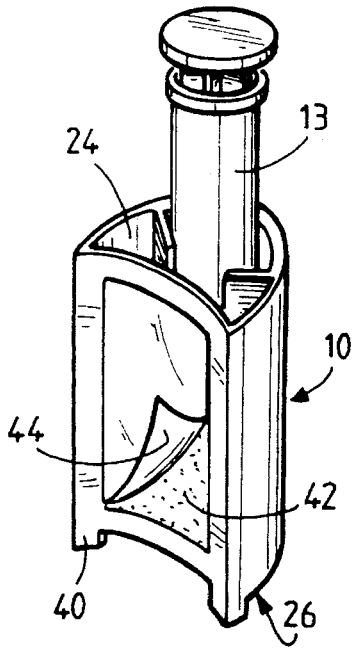
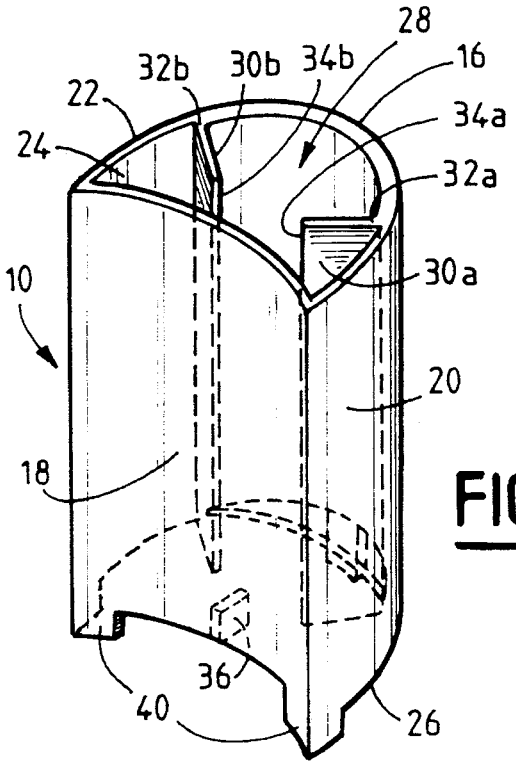
FIG. 3
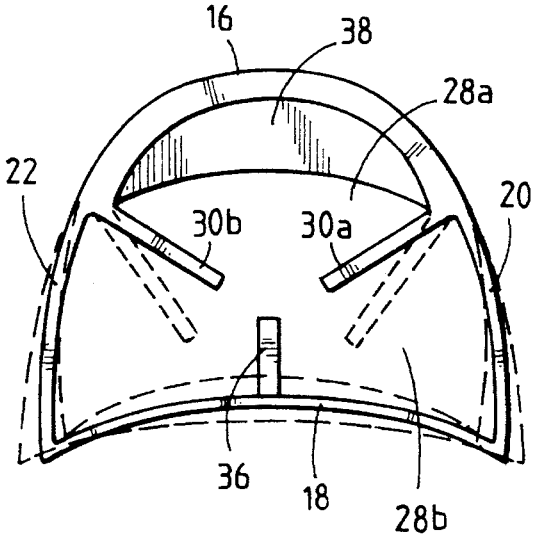
FIG. 4

CASE FOR A DOSING ACCESSORY ADAPTED TO BE FIXED ON A BOTTLE

FIELD OF THE INVENTION

The present invention relates to a case for accessories for measuring out or dosing, fixable on a bottle, comprising a front wall, a rear wall, two side walls, an open upper end and a lower end, said case presenting a housing adapted to receive, at least partially, an accessory for measuring out engaged via said open upper end.

BACKGROUND OF THE INVENTION

Numerous products; contained in bottles, for example medicines in the forth of solutes, must be dispensed in doses. To that end, one or more dosing or measuring-out accessories are generally disposed in the packing of the bottles. One known mode of packing these dosing accessories, which may be spoons, pipettes or dosing syringees, consists simply in sliding them against the bottles, in the box used as packing.

This mode of packing presents practical drawbacks, since it renders the removal of the accessory from the packing and its storage therein relatively fastidious.

Moreover, it does not satisfy the conditions of hygiene, since it provides no protection of the accessory against a possible contamination.

Attempts have already been made to overcome these drawbacks.

For example, Patent FR-A-993 774 discloses a support for droppers, comprising a fastening band stuck to the bottle, a pot adapted to receive the dropper and a collar, fixed on the fastening band, and holding the pot.

This support does not constitute a satisfactory solution, insofar as it comprises several elements which must be assembled prior to being fixed on the bottle.

This presents, on the one hand, the drawback of requiring manipulations which increase the manufacturing costs. On the other hand, the zones of assembly constitute as many zones of weakness.

It is an object of the present invention to overcome the drawbacks set forth hereinabove, by proposing a mode of storage for the measuring-out accessories, which is both practical and hygienic, without obliging the manufacturers to modify the packing of the bottles.

SUMMARY OF THE INVENTION

The housing is delimited by the front wall, the rear wall and the side walls, said front, rear and side walls being integral with one another. The rear wall is capable of being stuck on the bottle. The rear wall, like the side walls, are elastically deformable to fit on bottles of different curvatures.

Such a case does not present dimensions notably greater than those of the measuring-out accessory, which makes it possible to use it in pre-existing packing boxes, for example by arranging to stick it on a part of the bottle in an angle of the box.

This case makes it possible to remove bottles and measuring-out accessories from the box in one gesture and it constitutes a single place for storing the accessory, protected from possible contaminations. Furthermore, thanks to this case, the use of the packing box as mode of storage no longer constitutes an absolute necessity and the user can therefore discard this box, while remaining certain that the measuring-out accessory is neither mislaid nor soiled.

Furthermore, the case is made in one piece, preferably by moulding, which avoids any fastidious step of assembly prior to being fixed on the bottle.

Moreover, the front wall is closed, i.e. the front, rear and side walls are formed in continuity, only the upper end and possibly the lower end being open.

This avoids any untimely emergence of the measuring-out accessory from the case further to an awkward manipulation. The case may also perform the role of a member for protecting the accessory.

The fact that the rear wall and the side walls of the case are elastically deformable constitute a certain advantage for the manufacturers, who may manufacture only one type of case to fit it on bottles of different shapes, for example on flat bottles or on bottles whose wall presents any radius of curvature, particularly on bottles of circular section, of different diameters.

In order to preserve the integrity of the housing when the rear and side walls are deformed to fit on bottles of different curvature, the front wall of the case is advantageously substantially rigid. This may for example be obtained by providing the front wall with a thickness greater than the thickness of the side walls and than that of the rear wall.

Depending on the matter used and the expected amplitude of deformation, the thickness of the deformable walls (rear and side) is typically within the range of 30% to 70% of that of the substantially rigid front wall.

According to a preferred embodiment, the case further comprises two elastically deformable tongues extending in the housing, substantially towards the rear wall. These two tongues separate the housing into a front part and a rear part. Each of them presents a first side fast with the case at the level of the join of the front wall with one of the side walls and a second free side.

These elastically deformable tongues make it possible to hold measuring-out accessories of different shapes in the case. For example, a spoon may be used as dosing accessory, whose handle will be slid in the rear part of the housing of the case and will be maintained against this rear part by the free side of each of the two tongues which, being elastically deformed, will abut against this handle.

The front part of the housing of the case may also be used for inserting a measuring-out accessory, for example a pipette of generally cylindrical form which will be maintained against the front wall of the case by the free side of each of the two lateral tongues which abut in the same way against this pipette. Of course, it is possible to use only the front part or only the rear part of the housing for sliding one accessory, but these two parts may also be used simultaneously for receiving two dosing accessories.

As the majority of the measuring-out accessories have to be placed in contact with the liquid to be dosed, at least over a part, it is important that the wetted part be able to dry after use. If the dosing accessory used is a spoon of which only the handle is fitted in the case, this does not raise any problem since the useful part of the spoon is consequently in the open air.

On the other hand, where it is precisely the wetted end of the dosing accessory, for example a pipette, which is engaged in the case, means for circulating air around this wetted end are advantageously provided. To that end, the lower end of the case is open and presents means for retaining the dosing accessory.

BRIEF DESCRIPTION OF THE DRAWINGS

The invention will be more readily understood on reading the following description with reference to the accompanying drawings, in which:

FIG. 1 shows a bottle provided with a case according to the invention receiving a measuring spoon.

FIG. 2 shows a case according to the invention receiving a dosing pipette.

FIG. 3 shows, in perspective, an empty case according to the invention.

FIG. 4 shows the case of FIG. 3, seen from above.

DESCRIPTION OF PREFERRED EMBODIMENT

Referring now to the drawings, FIG. 1 firstly shows a bottle 14 on the wall of which is stuck a case 10 receiving a measuring-out or dosing accessory constituted by a measuring spoon 12. This bottle 14 is intended to contain a product to be dosed, in liquid form. This product may for example be a syrup or another liquid medicine to be dosed.

As shown in FIG. 2, the dosing accessory may also be constituted by a pipette or dosing syringe 13. In fact, the case 10 is adapted to receive any measuring-out accessory of generally elongated form and of reduced dimensions, of the type currently used.

Referring to FIGS. 3 and 4, it is seen that the case for measuring-out accessory according to the invention comprises a front wall 16, a rear wall 18, two side walls 20 and 22, an open upper end 24 and a lower end 26. The rear wall 18 is capable of being stuck on the bottle 14 and this rear wall, as well as the side walls 20 and 22, are elastically deformable to fit on bottles of different curvatures.

In fact, it is noted in FIG. 1 that, once the case 10 is stuck on the bottle 14, the curvature of the rear wall 18 is the same as the curvature of the wall of the bottle. This is obtained precisely because the rear wall 18 and the side walls 20 and 22 are elastically deformable.

Thanks to this property, the case according to the invention may even be fitted on bottles whose horizontal section presents a variable curvature. The fact that not only the rear wall, but also the side walls are elastically deformable, make it possible to pass the deformations of said rear wall to the side walls and, consequently, enables the case according to the invention to be truly adapted to bottles of different curvatures. Thanks to this property, the position of the join of the rear wall with each of the two side walls may change slightly, whilst preserving the housing.

According to a preferred embodiment, and precisely with a view to preserving housing 28, the front wall 16 is substantially rigid. As is particularly visible in FIG. 4, this may be possible thanks to the fact that the thickness of this front wall 16 is greater than the thickness of the side walls 20 and 22 and than the thickness of the rear wall 18. Although this is not indispensable, the same thickness for the rear wall and the side walls may be chosen.

FIG. 4 is a plan view of a case according to the invention, in which the solid lines represent the walls in a non-deformed position and the broken lines the possible deformations of these walls. This Figure shows that, seen from above or in horizontal section, the rear wall 18 has a mean radius of curvature greater than the mean radius of curvature of the assembly constituted by the front wall 16 and the side walls 20, 22. In fact, this assembly is generally convex, and the rear wall 18 may also be convex with a larger radius of curvature, or even plane.

In all the Figures, it is observed that the case 10 for measuring-out accessory further comprises two tongues **30*a* and 30*b* extending in the housing 28, substantially towards the rear wall 18, separating this housing 28 into a front part 28*a* and a rear part 28*b*. These tongues 30*a* and 30*b* are elastically deformable as shown in FIG. 4 which shows them in solid lines in a non-deformed position and in broken lines in a deformed position. Each of the tongues 30*a*, 30*b* presents a first side 32*a*, 32*b* fast with the case 10 at the level of the join of the front wall 16 with one of the side walls 20, 22 and a second free side 34*a*, 34*b***.

The rear part **28*b* of the housing 28, located to the rear of the tongues 30*a* and 30*b*, is adapted to receive a first measuring-out accessory 12 capable of being held in place against the rear wall 18 by the elastically deformable tongues 30*a* and 30*b*. The dosing accessory 12 may for example be constituted by a measuring spoon whose sleeve is relatively flat. When this sleeve is engaged in the rear part 28*b* of the housing 28, due to its very thickness, it pushes the free sides 34*a* and 34*b* of the elastic tongues 30*a* and 30*b* slightly towards the front wall of the case 10. Then, under the elastic return effect, these elastically deformable tongues 30*a* and 30*b* come into abutment against the front face of the handle of the accessory 12 and push it against the rear wall 18 of the case 10**.

The front part **28*a* of the housing 28 is also adapted to receive a measuring-out accessory, capable of being held in place against the front wall 16 by the elastically deformable tongues 30*a* and 30*b*. In the example shown, this front part 28*a* is particularly adapted to receive a measuring-out accessory of generally cylindrical shape such as a syringe or pipette 13. When such an accessory is engaged in the front part 28*a* of the housing 28, it pushes the tongues 30*a* and 30*b* towards the rear, as shown in broken lines in FIG. 4**, and the front faces of these tongues abut against the accessory, under the simple effect of the elastic return.

In certain cases, it may be desired to use the two parts **28*a* and 28*b* of the housing 28 to house therein two measuring-out accessories. Likewise, only the front part 28*a* or only the rear part 28*b*** may, of course, be used.

When the lower end 26 of the case 10 is closed, it is preferable if the lower ends of each of the two tongues are not welded on this lower end 26 in order to allow elastic deformation thereof. For example, it may be provided that these tongues extend only in an upper part of the case 10.

However, as observed in FIGS. 3 and 4, the lower end 26 of the case 10 is advantageously open and presents means 36, 38 for retaining the measuring-out accessory. As set forth hereinabove, this open lower end 26 allows a circulation of air around the lower end of the accessory, which proves particularly useful for accessories such as pipettes or syringes 13 of which the endpiece engaged in the case 10 is wet.

The means for retaining the measuring-out accessory advantageously comprise a first stop member 36 projecting towards the inside of the housing 28 from the rear wall 18, and a second stop member 38 projecting inwardly of the housing 28 from the front wall 16. In the example shown, the first stop member 36 is a simple tab while the second stop member 38 is in the form of a crescent. Obviously, other forms of embodiment may be provided, but it is important that the dimensions of the stop members remain reduced, so as to allow circulation of air in the lower part of the case.

According to a preferred embodiment, the case 10 comprises tabs 40 extending it downwardly beyond its lower end 26. These tabs 40 quite simply make it possible to position the case 10 when it is being stuck on the wall of the bottle, keeping it slightly at a distance from the surface of the work surface. They obviously present a particular advantage when, the lower end 26 of the case 10 being open, it is desired to arrange a circulation of air around the bottom of the accessory. The case shown by way of example comprises three tabs 40 of which two are located towards the rear wall and one is placed on the front wall. A different number of tabs may be provided.

According to a preferred embodiment, as illustrated in FIG. 2, the rear wall 18 is at least partially coated with an adhesive substance 42 and the case 10 further comprises a removable protective film 44 which initially covers said adhesive substance 42 and which may be removed at the moment of sticking the case 10 on the bottle 14.

Various modifications may, of course, be made to the case which has just been described, without departing from the scope of the invention.

What is claimed is:

1. A case for a dosing accessory adapted to be fixed on a bottle comprising a front wall, a rear wall, two side walls, an open upper end and a lower end, said case presenting a housing adapted to receive, at least partially, a dosing accessory received via said open upper end, wherein:

a) the housing is delimited by the front wall, the rear wall and the side walls, all of said walls being integral with one another, b) the rear wall is capable of being adhered to the bottle, and c) the rear wall and the side walls are elastically deformable and fit bottles of different curvatures.

2. The case of claim 1, wherein the front wall is substantially rigid.

3. The case of claim 2, wherein the thickness of the front wall is greater than the thickness of the side walls and than the thickness of the rear wall.

4. The case of claim 1, wherein, in the non-deformed state, the rear wall has a mean radius of curvature greater than the mean radius of curvature of the assembly constituted by the front wall and the side walls.

5. The case of claim 1 further comprising two elastically deformable tongues extending in the housing, substantially towards the rear wall, separating said housing into a front part and a rear part.

6. The case of claim 5 wherein the rear part of the housing is adapted to receive a dosing accessory capable of being maintained in place against the rear wall by the elastically deformable tongues.

7. The case of claim 5 wherein the front part of the housing is adapted to receive a dosing accessory capable of being maintained in place against the front wall by the elastically deformable tongues.

8. The case of claim 1, wherein the lower end is partially open and includes stop means for restricting downward movement of the dosing accessory.

9. The case of claim 8 wherein the stop means comprises a first stop member projecting towards the inside of the housing from the rear wall, and a second stop member projecting inwardly of the housing from the front wall.

10. The case of claim 1 further comprising tabs extending it downwardly beyond the lower end.

11. The case of claim 1 wherein the rear wall is at least partially coated with an adhesive substance and comprises a removable protective film initially covering said adhesive substance.

* * * * *